United States Patent [19]

DeBolt

[11] Patent Number: 4,671,586

[45] Date of Patent: Jun. 9, 1987

[54] SPARK PLUG SHIELD AND BOOT SEAL ASSEMBLY

[75] Inventor: Richard R. DeBolt, Metamora, Mich.

[73] Assignee: General Motors Corporation, Detroit, Mich.

[21] Appl. No.: 854,658

[22] Filed: Apr. 16, 1986

Related U.S. Application Data

[63] Continuation of Ser. No. 682,294, Dec. 17, 1984, abandoned.

[51] Int. Cl.[4] ..... H01R 11/28; H01R 13/648

[52] U.S. Cl. ..... 439/126; 439/607

[58] Field of Search ..... 339/26, 112 R, 143 S, 339/218 S

[56] References Cited

U.S. PATENT DOCUMENTS

| | | | |
|---|---|---|---|
| 1,950,596 | 3/1934 | Corbin | 339/218 S |
| 1,995,483 | 3/1935 | Rabezzana | 339/218 S |
| 3,128,139 | 4/1964 | Estes | 339/26 |
| 3,178,661 | 4/1965 | Kirchgessner | 333/79 |
| 4,145,106 | 3/1979 | Livingston | 339/26 |
| 4,159,441 | 6/1979 | Livingston | 339/26 |
| 4,497,532 | 2/1985 | Bezusko et al. | 339/112 R |
| 4,514,712 | 4/1985 | McDougal | 339/26 |

*Primary Examiner*—Gil Weidenfeld
*Assistant Examiner*—Gary F. Paumen
*Attorney, Agent, or Firm*—Charles R. White

[57] ABSTRACT

A rotationally interlocked heat shield and spark plug boot seal assembly with internal air flow cooling passages that also provide fluid drains to keep the boot seal dry. The shield doubles as a boot seal removal tool for service and grounds to the cylinder head instead of the spark plug giving good feel when engaging the spark plug clip. Corona and dielectric puncture is reduced by grounding the shield and coating the internal diameter of the shield with a suitable conductive layer of material.

6 Claims, 3 Drawing Figures

SPARK PLUG SHIELD AND BOOT SEAL ASSEMBLY

This is a continuation of application Ser. No. 682,294, filed on Dec. 17, 1984, now abandoned.

This invention relates to spark plug shielding and more particularly to a new and improved push-on shield and boot seal assembly for spark plugs providing heat and RFI insulation.

High temperatures generated by many internal combustion engines have adversely affected the elastomeric boot seals used on spark plugs often causing them to become brittle, cracked and worn. With such wear, the effectiveness of the boot seals in maintaining and protecting spark plugs and their electrical connections to ignition wires are sharply diminished. To provide spark plug boot seal protection in such high temperature environment, a variety of expensive and custom made heat shields have been utilized. While such shields have generally been effective for their intended purpose, they are often costly and do not meet higher standards for improved installation, operation and serviceability. To this end, the present invention provides for a new and improved heat shield and boot seal assembly for spark plugs featuring 360° protection and advanced serviceability. The present invention further advantageously provides a rotational interlock between a thin-walled outer tubular heat shield aluminum or other lightweight metal and a thick-walled inner tubular boot seal of elastomer. With this interlock torque applied externally to the boot seal and shield breaks the elastomer boot seal from adherence to the porcelain surface of the spark plug. This also helps free the electrical connection between the spark plug and ignition cable if the connection is corroded or otherwise fused together. With the boot seal rotationally freed from the spark plug, axial removal of the boot seal and shield is facilitated so that the spark plug can be serviced. After such service the reusable outer shell comprising the heat shield can be easily inserted over a replacement elastomer boot seal, if such is required, and the assembly can be axially inserted over the serviced spark plug and into the spark plug counterbore in the engine block. The end portion of the tubular heat shield is comprised of arcuate segments of reduced diameter that constricts and spring fits into the spark plug counterbore to provide circular spring retention and effective electrical grounding of this assembly. Importantly, the new and improved assembly does not cause the installer to believe that the electrical connection has been accomplished by interference fitting over the hex head of the spark plug as in the case with some prior art devices. Equally spaced slits in the reduced diameter end of the outer shell, while providing the spring retainer segments to yieldably retain the outer heat shield securely in place, also provide openings for ventilation and for water drainage. With this invention, there is improved air circulation space provided between the interior of the heat shield and the outside of the elastomer boot for dissipation of the heat energy otherwise concentrating in the interior of the assembly.

These and other features, objects and advantages of this invention will be more apparent from the following detailed description and drawing in which.

Figure 1:
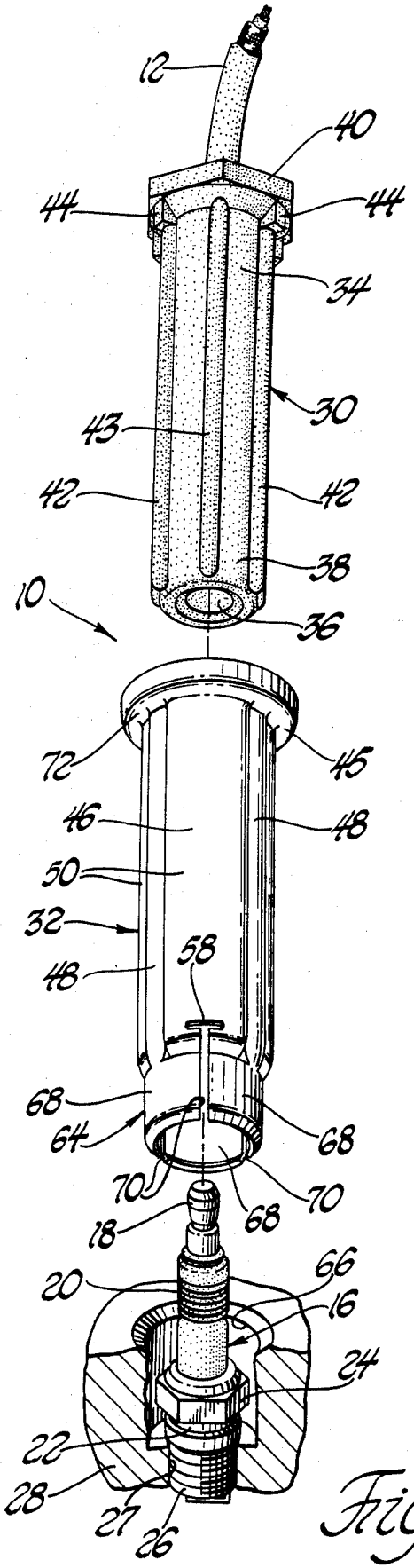
FIG. 1 is an exploded axonometric view of a heat shield and boot seal assembly for a spark plug mounted in an engine cylinder block.

Referring now to the drawing, there is illustrated a heat shield and spark plug boot seal assembly 10 illustrated in conjunction with ignition cable 12, a socket terminal 14 and a spark plug 16. The ignition cable 12 is a high energy T.V.R.S. cable which has a non-metallic conductive core and a high temperature silicone insulation jacket. The socket terminal 14 is attached to the end of the ignition cable 12 by a conventional strip and fold technique and may be of any suitable design preferably for push-on connection to the spark plug 16.

The spark plug 16 is likewise of conventional design and standard configuration. It comprises a stud terminal 18 which plugs into the socket terminal 14, a ceramic insulator 20 and a metal base or shell 22 having a hex head 24 and a threaded shank 26 by means of which the spark plug is screwed into an internally threaded opening 27 communicating with the combustion chamber in the cylinder head 28.

Figure 2:
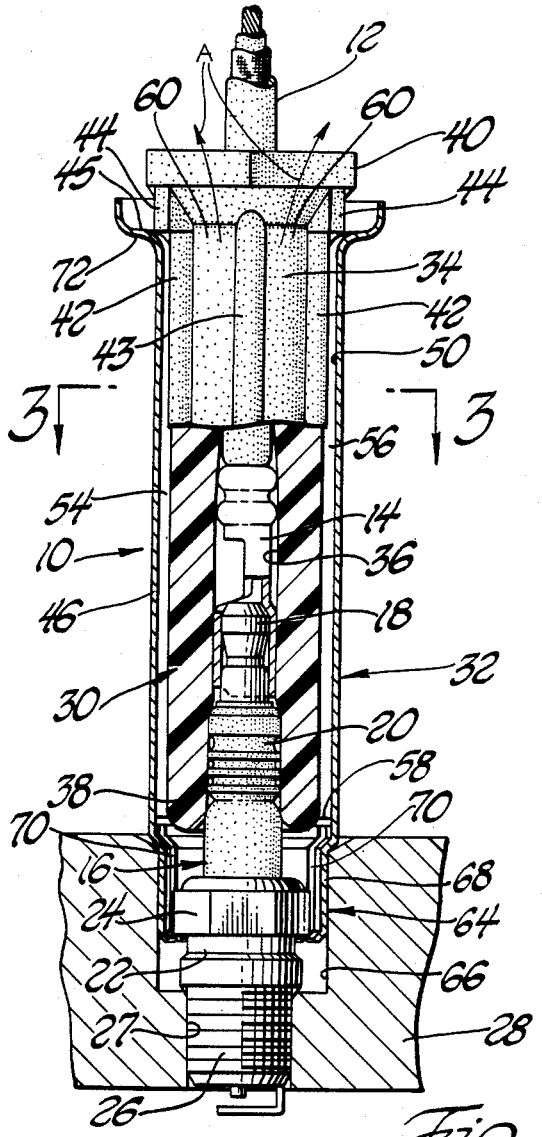
FIG. 2 is a side view partially in section of the heat shield and boot seal assembly of FIG. 1 installed on a spark plug mounted in a counterbore of an engine cylinder block.

The heat shielded spark plug boot assembly 10 comprises an elongated thick-walled spark plug boot seal 30 of a suitable elastomer material and a thin-walled, metallic heat shield 32 which surrounds the boot seal 30. The boot seal 30 has a cable end portion 34, an intermediate cavity portion 36 and a seal end portion 38. The cable end portion 34 has a bore which is sized so as to sealingly engage around the silicone jacket of the ignition cable 12. The bore of the intermediate cavity portion 36 is somewhat larger to provide room for the socket terminal 14 attached to the end of the ignition cable 12. The bore of the seal end portion 38 is sized to sealingly engage around the ceramic insulator 20 of the spark plug 16 as best shown in FIG. 2 to protect the spark plug and to prevent the entry of water and foreign matter into the electrical, push-on connection between the socket terminal 16 and the stud terminal of the spark plug.

Figure 3:
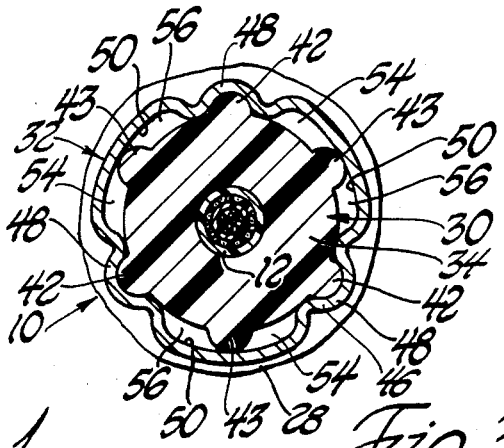
FIG. 3 is a cross-sectional view taken along sight lines 3—3 of FIG. 2.

The spark plug boot seal 30 has a hex head 40 at the cable end which serves as a gripping surface for the hand or for tools so that a torque can be applied to the assembly to assist in removal of the assembly from the spark plug. The outside of the boot seal 30 has a plurality of integral arcuately spaced, longitudinal ribs 42 and 43. These ribs extend from the hex head 40 to the seal end of the boot seal as shown in FIG. 1 and are semi-circular in cross-section as shown in FIG. 3. The boot seal 30 also has a number of integral stop lugs 44 which extend downwardly from the hex head 40 to contact an upper flange 45 of the heat shield 32. The outer periphery of the boot seal 30 including the ribs 42, 43 fits within the heat shield 32 so that the boot seal can be easily linearly inserted into the heat shield 32 from the upper end thereof.

The heat shield 32 is an elongated thin wall cylindrical shell of aluminum or other lightweight metal that peripherally surrounds the elastomeric boot as shown in the Figures. This shield is fluted from its upper flange 45 to have three internal connector channels 48 to form tracks for receiving the elongated external ribs 42 of the boot. This provides a spline-like connection that interconnects the boot seal 30 and the shield 32 so that they can be turned as a unit to overcome the gripping force between the ceramic portion of the spark plug and the elastomer boot seal. Also the electrical connection if fused together can be loosened by this rotation. Once rotationally loosened form the spark plug, the assembly can be axially removed as will be further pointed out below. In addition to the connector channels 48, the shell 46 has wide internal airflow and water drain channels 50 which are interposed between the semi-circular and small radiused connector channels 48. The airflow and water drain channels 50 accommodate ribs 43 which contact the inner wall of these channels to provide for radial inner support thereof and to provide separate elongated fluid passages 54, 56 through the space between the shell and the boot. The bottom of passages 54, 56 opens to the exterior of the shell by the arcuately disposed longitudinal slots 58 formed through the wall of the shell adjacent the lower end thereof. The upper end of passages 54, 56 open to the exterior through vents 60 formed between the boot seal and the heat shield as best shown in FIG. 2. With this design, airflow through the passages 54, 56 illustrated by flow arrows A can effectively dissipate heat energy and lower boot temperatures to a point in which the elastomer is not heat damaged. Also, any moisture collecting in the assembly will drain through the lower slots 58.

The lower end portion 64 of the heat shield is reduced in diameter to fit into the spark plug counterbore 66 in the cylinder head 28 and has three arcuate segments 68 separated by three elongated slots 70 which extend from the lower end of the heat shield until termination by intersection with the longitudinal slots 58. With this construction, three arcuate spring fingers are formed by segments 68 which yieldably fit against the inner wall of the spark plug counterbore 66 which substantially provides 360° support and which blocks entry of foreign matter into the counterbore.

The upper flange 45 of the heat shield 32 is dished outwardly, the underside of which forms a smooth cylindrical-like head 72 which can be grasped by the mechanic's fingers to allow the axial withdrawal of the boot seal and shield assembly from connection with the spark plug and the spark plug counterbore. After spark plug service, the whole assembly can be easily and accurately installed on a spark plug. When inserted the arcuate segments of the shield enter the counterbore 66 radially clear of the hex head 24 of the spark plug. Since there is no interference from the hex head, the only connection which the mechanic senses will be the resistance provided by the push-on connection of the socket terminal with the stud terminal. Accordingly, the mechanic will be assured that the electrical connection has been made.

If desired, the heat shield 32 can be provided with spray and powder coatings of high temperature dielectric material such as Ryton, epoxy, applied directly to the inner wall of the heat shield 32. This dielectric barrier extends past the seal end portion 38 of the elastomeric boot seal 30. This prevents electrical puncture of the boot seal by providing a path for corona discharge to ground via the coated inner wall of the heat shield to the counterbore 66 with physical contact made by the arcuate segments 68.

While a preferred embodiment has been shown and described to illustrate the invention, other embodiments will become apparent to those skilled in the art. Accordingly, the scope of this invention is set forth in the following claims.

The embodiments of the invention in which an exclusive property or privilege is claimed are defined as follows:

1. An elastomer boot seal and metal heat shield separable from one another and providing an assembly for operatively connecting an ignition cable assembly to a stud terminal forming the upper part of a spark plug having a threaded lower part connected into a bore in an engine block and having a wrenching head facilitating installation and removal of said plug with respect to the bore, the improvement comprising a generally cylindrical block of elastomeric material to provide a boot seal for covering and protecting an electrical fitting removably connecting the ignition cable to the stud terminal, a thin-walled and generally cylindrical shield of metal having a large diameter main body portion with an open upper end through which said boot seal is inserted, said metallic heat shield having a lower open end of reduced diameter as compared to said main body portion to closely fit in said bore and radially spaced from and clear of the polygonal head of said spark plug to permit the unencumbered coupling of said electrical fitting on said stud terminal and for directly contacting the wall of said bore to provide an electrical ground for electrical discharge from said cable, said boot seal having a plurality of integral elongated ribs radially spaced from one another extending outwardly therefrom, said main body of said shield having a plurality of elongated radially spaced channels therein to correspond with and slidably receive said ribs to form a spline like connection between said shield and said boot seal, said boot shield having a head portion at the upper end thereof so that said boot seal and said shield can be turned as a unit with respect to said bore and said spark plug by torquing said head portion to free the electrical fitting from the stud terminal to facilitate the axial removal of said assembly from said bore and from said spark plug.

2. An elastomer boot seal and metal heat shield separable from one another providing an assembly for operatively connecting an ignition cable assembly to a stud terminal forming the upper part of a spark plug having a threaded lower part connected into a bore in an engine block and having a wrenching head facilitating installation and removal of said plug with respect to the bore, the improvement comprising a generally cylindrical block of elastomeric material to provide a boot seal for covering and protecting an electrical fitting removably connecting the ignition cable to the stud terminal, a thin-walled and generally cylindrical shield of metal having a large diameter main body portion with an open upper end through which said boot seal is axially inserted, said metallic heat shield having a lower open end of reduced diameter as compared to said main body portion and of a greater diameter than the largest diameter of said wrenching head to closely fit in said bore and to radially clear the polygonal head of said spark plug so that said open end is spaced from the wrenching head to permit the unencumbered coupling of said electrical fitting on said stud terminal and for directly contacting the wall of said bore to provide an electrical ground for electrical discharge from said cable, said boot seal having a plurality of integral elongated ribs radially spaced from one another extending outwardly therefrom and along the length thereof, said main body of said shield having a plurality of elongated radially spaced channels therein to correspond with and slidably receive said ribs without substantial deflection thereof to form a spline-like interlock connection between said shield and said boot seal, said boot shield having a head portion at the upper end thereof so that said boot seal and said shield can be turned as a unit with respect to said bore and said spark plug by torquing said head portion to free the electrical fitting from the stud terminal to facilitate the axial removal of said assembly from said bore and from said spark plug.

3. An elastomer boot seal and metal heat shield assembly for operatively connecting an ignition cable assembly to a stud terminal forming the upper part of a spark plug, the spark plug having a threaded lower part connected into a bore in an engine block and having a polygonal wrenching head facilitating installation and removal of said plug with respect to the bore, the improvement comprising a generally cylindrical block of elastomeric material to provide a boot seal for covering and protecting a push-on socket terminal releasably connecting the ignition cable to the stud terminal of the spark plug, a thin-walled and generally cylindrical shield of metal having a large diameter main body portion with an outwardly extending head to provide a gripping surface for the manual removal of said assembly from said stud terminal and said bore, said head also providing an open end through which said boot seal is axially inserted, said metallic heat shield having a lower open end of reduced diameter as compared to said main body portion contacting the walls defining said bore and having a diameter greater than the diameter of said wrenching head compassing and radially spaced from the polygonal head of said spark plug to facilitate the push-on installation of said socket terminal onto said stud terminal, said boot seal having a plurality of integral elongated ribs radially spaced from one another and extending outwardly from said block of said elastomeric material coextensive with the length thereof, said main body portion of said shells having a plurality of channels which conform to said ribs without substantial deflection thereof to provide an axially slidable spline like connection between said shield and said boot seal so that said shield and said boot seal can be turned as a unit by application of a turning force to the upper end of said boot seal to facilitate removal of said assembly from said spark plug and said bore.

4. An elastomer boot seal and metal heat shield assembly for operatively connecting an ignition cable assembly to the stud terminal forming the upper part of a spark plug, the spark plug having a threaded lower part connected into a bore in an engine block and having a polygonal wrenching head facilitating installation and removal of said plug with respect to the bore, the improvement comprising a generally cylindrical block of elastomeric material to provide a boot seal covering and protecting a push-on electrical connection removably connecting the ignition cable to the stud terminal, a thin-walled and generally cylindrical heat shield of metal having a large diameter main body portion with an open end through which said cylindrical block is inserted, said metallic heat shield having a lower open end in the form of spaced arcuate spring segments, said open end having a reduced diameter as compared to said main body portion for closely fitting in said bore and encircling and radially spaced from the polygonal head of said spark plug to permit the push-on coupling of said connector on said stud terminal without any contact of said lower open end and said polygonal head of said spark plug, said boot seal having peripheral ribs extending along the height of said seal and projecting radially therefrom to match and releasably slide into corresponding grooves in said heat shield without deformation of said ribs to thereby rotationally interlock said heat shield and boot seal and to allow said boot seal to be readily axially separated from said. shield, said boot seal having a gripping surface extending beyond the upper end of said heat shield to allow the boot seal to be gripped and the boot seal and heat shield to be turned as a unit, said heat shield having an upper radial flange disposed below and outwardly of said gripping surface of said boot seal and in contact therewith so that said flange can be manually grasped and said boot seal and heat shield can be axially removed as a unit from said spark plug and said engine block.

5. The assembly defined in claim 4, wherein said heat shield has elongated open channels formed between said grooves which cooperate with said boot seal to form elongated passages between the boot seal and the interior wall of said shield providing passages for the flow of cooling air therethrough and for draining collected liquid from said assembly.

6. An elastomer boot seal and metal heat shield assembly for operatively connecting an ignition cable assembly to the stud terminal forming the upper part of a spark plug, the spark plug having a threaded lower part connected into a bore in an engine block and having a polygonal wrenching head facilitating installation and removal of said plug with respect to the bore, the improvement comprising a generally cylindrical block of elastomeric material to provide a boot seal covering and protecting a push-on electrical connection removably connecting the ignition cable to the stud terminal, a thin-walled and generally cylindrical heat shield of metal having an open end through which said cylindrical block is inserted, said metallic heat shield having arcuate segments providing a resilient lower open end of reduced diameter with respect to the body of said shield, said lower open end being radially spaced from the polygonal head of said spark plug to permit the push-on coupling of said connector on said stud terminal without any contact of said polygonal head and said shield, said metallic heat shield having a plurality of elongated grooves formed internal thereof, said boot seal having integral peripheral ribs extending radially therefrom to match and releasably fit into said grooves in said heat shield to thereby rotationally interlock said heat shield and boot seal together, said boot seal having a gripping surface extending beyond the upper end of said heat shield to allow the boot seal to be gripped and the boot seal and heat shield to be turned as a unit, said heat shield having an upper flange disposed below said gripping surface of said boot seal and in contact therewith so that said flange can be manually grasped and said boot seal and heat shield can be axially removed as a unit from said spark plug, said heat shield having elongated channels formed between said grooves and between said shield and said boot seal to thereby form elongated passages between the boot seal and the interior wall of said shield providing passages for the flow of cooling air therethrough and for draining collected liquid from said assembly.

* * * * *